US011441764B1

(12) United States Patent
Zhu

(10) Patent No.: US 11,441,764 B1
(45) Date of Patent: Sep. 13, 2022

(54) OUTDOOR WATERPROOF WALL LAMP SYSTEM WITH DOORBELL AND HUMAN BODY SENSING FUNCTIONS

(71) Applicant: Zhongshan weihua lighting technology co., ltd., Zhongshan (CN)

(72) Inventor: Xiaohua Zhu, Zhongshan (CN)

( * ) Notice: Subject to any disclaimer, the term of this patent is extended or adjusted under 35 U.S.C. 154(b) by 0 days.

(21) Appl. No.: 17/533,024

(22) Filed: Nov. 22, 2021

(30) Foreign Application Priority Data

Oct. 20, 2021 (CN) ..... 202122534731.2

(51) Int. Cl.

| | |
|---|---|
| ***F21V 23/04*** | (2006.01) |
| ***H04R 1/02*** | (2006.01) |
| ***G08B 3/10*** | (2006.01) |
| ***F21V 31/00*** | (2006.01) |
| *F21W 131/107* | (2006.01) |
| *F21Y 115/10* | (2016.01) |

(52) U.S. Cl.
CPC ..... *F21V 23/0471* (2013.01); *F21V 23/0464* (2013.01); *F21V 31/00* (2013.01); *G08B 3/10* (2013.01); *H04R 1/028* (2013.01); *F21W 2131/107* (2013.01); *F21Y 2115/10* (2016.08)

(58) Field of Classification Search
CPC .... F21V 23/0471; F21V 23/0464; G08B 3/10
See application file for complete search history.

(56) References Cited

U.S. PATENT DOCUMENTS

| | | | | |
|---|---|---|---|---|
| 5,131,048 | A * | 7/1992 | Farenelli | H04M 1/715 381/81 |
| 5,434,764 | A * | 7/1995 | Lee | F21S 8/033 362/802 |
| 10,677,449 | B1 * | 6/2020 | Cui | F21V 33/0056 |
| 2004/0124978 | A1 * | 7/2004 | Chen | G08B 15/001 340/539.14 |
| 2018/0077391 | A1 * | 3/2018 | Siminoff | H02G 3/12 |
| 2019/0333349 | A1 * | 10/2019 | Hsu | F21V 23/0471 |
| 2021/0099624 | A1 * | 4/2021 | Cui | F21V 33/0056 |

(Continued)

*Primary Examiner* — Bryon T Gyllstrom
*Assistant Examiner* — Christopher E Dunay

(57) ABSTRACT

The present invention discloses an outdoor waterproof wall lamp system with doorbell and human body sensing functions, including: a lamp body assembly, including a lamp housing, a lamp body, a multifunctional sensor, a first circuit board, and a button switch, wherein the lamp body, the multifunctional sensor, and the button switch are all electrically connected to the first circuit board, and the multifunctional sensor has a human body sensing module for sensing a human body to control the lamp body to be lighted; and a doorbell assembly, including a doorbell housing, a second circuit board, and a speaker, wherein the speaker is connected to the second circuit board, the second circuit board is communicatively connected to the first circuit board, and the speaker may be controlled to sound when the button switch is pressed. With the above technical solution, the human body sensing module feeds information back to the first circuit board after sensing a human body, and the first circuit board controls the lamp body to be lighted. Thus, when a visitor visits at night, the human body sensing module may control the lamp body to be lighted after sensing the human body, which is convenient for the visitor to walk and find the button switch, with good practicability.

9 Claims, 3 Drawing Sheets

(56) References Cited

U.S. PATENT DOCUMENTS

| | | | | |
|---|---|---|---|---|
| 2021/0099676 | A1* | 4/2021 | England | H04N 5/2258 |
| 2021/0337090 | A1* | 10/2021 | Pritchett | H04N 5/225251 |
| 2022/0090770 | A1* | 3/2022 | Kelley | F21V 23/023 |
| 2022/0124226 | A1* | 4/2022 | Jeong | H04N 5/2252 |

* cited by examiner

OUTDOOR WATERPROOF WALL LAMP SYSTEM WITH DOORBELL AND HUMAN BODY SENSING FUNCTIONS

TECHNICAL FIELD

The present invention relates to the related technical field of wall lamps, and in particular to an outdoor waterproof wall lamp system with doorbell and human body sensing functions.

BACKGROUND ART

The English word for "门铃" is doorbell, that is, a bell on a door, which can produce sound to remind the owner that there is a visitor. Nowadays, relatively common doorbells include ordinary wireless doorbells, wireless doorbells without batteries, and wired doorbells.

At present, doorbells are widely used, but there are still some shortcomings. For example, for a family with an exclusive small yard, a doorbell is mounted on a door, and it is dark outside at night. When a visitor visits, it is inconvenient for the visitor to walk and see clearly the location of a doorbell button, so that its use is restricted to some extent.

SUMMARY OF THE INVENTION

In order to overcome existing technical defects, the object of the present invention is to provide an outdoor waterproof wall lamp system with doorbell and human body sensing functions, so as to solve the above technical problems.

The technical solution adopted to solve the technical problems of the present invention is as follows:

According to an aspect of the present invention, an outdoor waterproof wall lamp system with doorbell and human body sensing functions is designed, comprising: a lamp body assembly, comprising a lamp housing, a lamp body disposed in the lamp housing, a multifunctional sensor, a first circuit board, and a button switch, wherein the lamp body, the multifunctional sensor, and the button switch are all electrically connected to the first circuit board, and the multifunctional sensor has a human body sensing module for sensing a human body to control the lamp body to be lighted; and a doorbell assembly, comprising a doorbell housing, a second circuit board, and a speaker, wherein the second circuit board and the speaker are disposed in the doorbell housing, the speaker is connected to the second circuit board, the second circuit board is communicatively connected to the first circuit board, and the speaker may be controlled to sound when the button switch is pressed.

With the above technical solution, the lamp body assembly of this system is mounted on a wall at an outdoor doorway when in use, the doorbell assembly is mounted on an indoor wall when in use, the human body sensing module feeds information back to the first circuit board after sensing a human body, and the first circuit board controls the lamp body to be lighted. Thus, when a visitor visits at night, the human body sensing module may control the lamp body to be lighted after sensing the human body, which is convenient for the visitor to walk and find the button switch, with good practicability.

In order to better solve the above technical defects, the present invention also has a better technical solution:

In some embodiments, the lamp housing is provided with a mounting base connected thereto on one side, the mounting base is provided with a light emitting diode electrically connected to the first circuit board, a light transmitting hole is provided in the mounting base corresponding to the light emitting diode, the mounting base is provided with a mounting hole through which a pressing end of the button switch protrudes from the mounting base, the mounting hole is located under the light transmitting hole, the human body sensing module may control the light emitting diode to light up after sensing a human body, and the multifunctional sensor also has a light sensing module for sensing light to control the lamp body to be lighted or extinguished.

Thus, light information sensed by the light sensing module is fed back to the first circuit board, and the first circuit board may control the lamp body to be, lighted, extinguished or always lighted; the human body sensing module feeds information back to the first circuit board after sensing a human body, the first circuit board controls the light emitting diode to emit blue, yellow, red or purple light, etc., which is, projected out through the light transmitting hole, so as to achieve an effect of attracting a visitor's attention. It is convenient for the visitor to find and press the button switch by disposing button switch under the light transmitting hole.

In some embodiments, a water blocking case is connected to the top of the lamp housing, the multifunctional sensor is mounted in the water blocking case, and a side wall of the water blocking case is provided with an escape notch. Thus, a waterproof effect, can be achieved.

In some embodiments, plug sheets are connected to a rear cover of the doorbell housing, and the plug sheets are electrically connected to the second circuit board.

In some embodiments, a column body is provided between the lamp housing and the mounting base, and a first hollow threaded tube that connects the lamp housing and the mounting base together is provided in a through hole in the column body.

In some embodiments, a connecting bracket is disposed on a rear side of the mounting base, a mounting screw is connected to the connecting bracket, and a threaded end of the mounting screw is threadedly connected with a mounting nut through a through hole in the mounting base. Thus, it is convenient to mount and fix the mounting base.

In some embodiments, the water blocking case and the lamp housing are connected together by means of a second hollow threaded tube.

In some embodiments, the water blocking case comprises a water blocking shell, a cover sheet connected to the top of the water blocking shell, and a water blocking cover disposed on the cover sheet, and the water blocking cover and the cover sheet are connected together by means of a third hollow threaded tube.

In some embodiments, an insulating case is disposed in the mounting base, a light transmitting plate is disposed at the left end of the insulating case, the button switch and the light emitting diode are mounted on the first circuit board, the first circuit board is mounted in the insulating case, and the light transmitting plate is provided with a through hole through which the pressing end of the button switch passes.

In some embodiments, the multifunctional sensor is provided with an adjustment switch and a sensor mode switch.

REFERENCE SIGNS

1—Lamp housing; 2—Multifunctional sensor; 3—First circuit board; 4—Button switch; 5—Mounting base; 51—Column body; 52—First hollow threaded tube; 53—Light transmitting hole; 54—Mounting hole; 55—Insulating case; 56—Light emitting diode; 6—Bracket; 61—Mounting screw; 62—Mounting nut; 7—Water blocking case; 70—Escape notch; 71—Second hollow threaded tube; 72—Water blocking, shell; 73—Cover sheet; 74—Water blocking cover; 75—Third hollow threaded tube; 76—Cap; 81—Doorbell housing; 82—Second circuit board; 83—Speaker; 84—Rear cover; 8—Plug sheet.

DETAILED DESCRIPTION OF EMBODIMENTS

To make the object, technical solutions, and advantages of the present invention clearer, the present invention will be further described in detail below in conjunction with specific embodiments and with reference to the accompanying drawings. It should be understood that these descriptions are merely exemplary, and are not intended to limit the scope of the present invention. In addition, in the following description, descriptions of well-known structures and technologies are omitted, so as to avoid unnecessarily obscuring concepts of the present invention.

Figure 1:
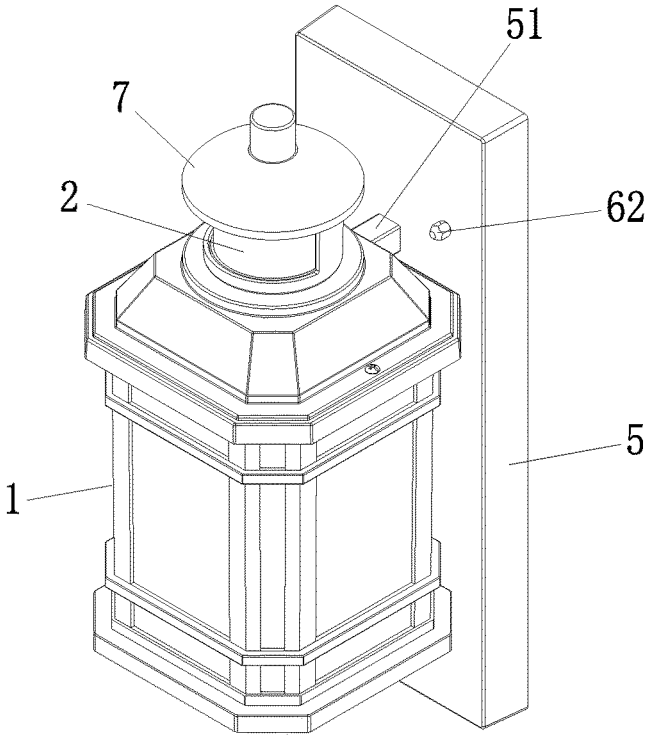
FIG. 1 is a schematic structural view of a lamp body assembly of an outdoor waterproof wall lamp system with doorbell and human body sensing functions in an embodiment of the present invention.
Figure 2:
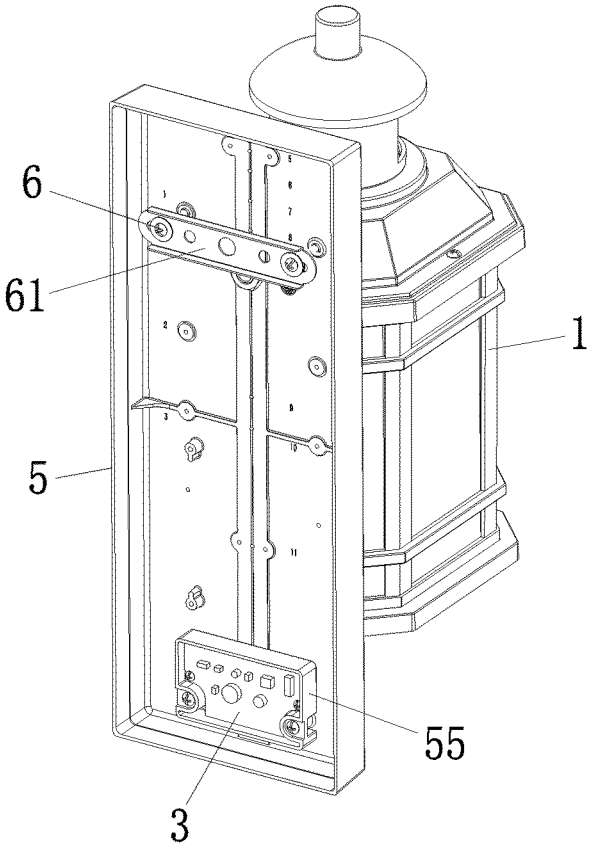
FIG. 2 is a schematic structural view of FIG. 1 from another perspective.
Figure 3:
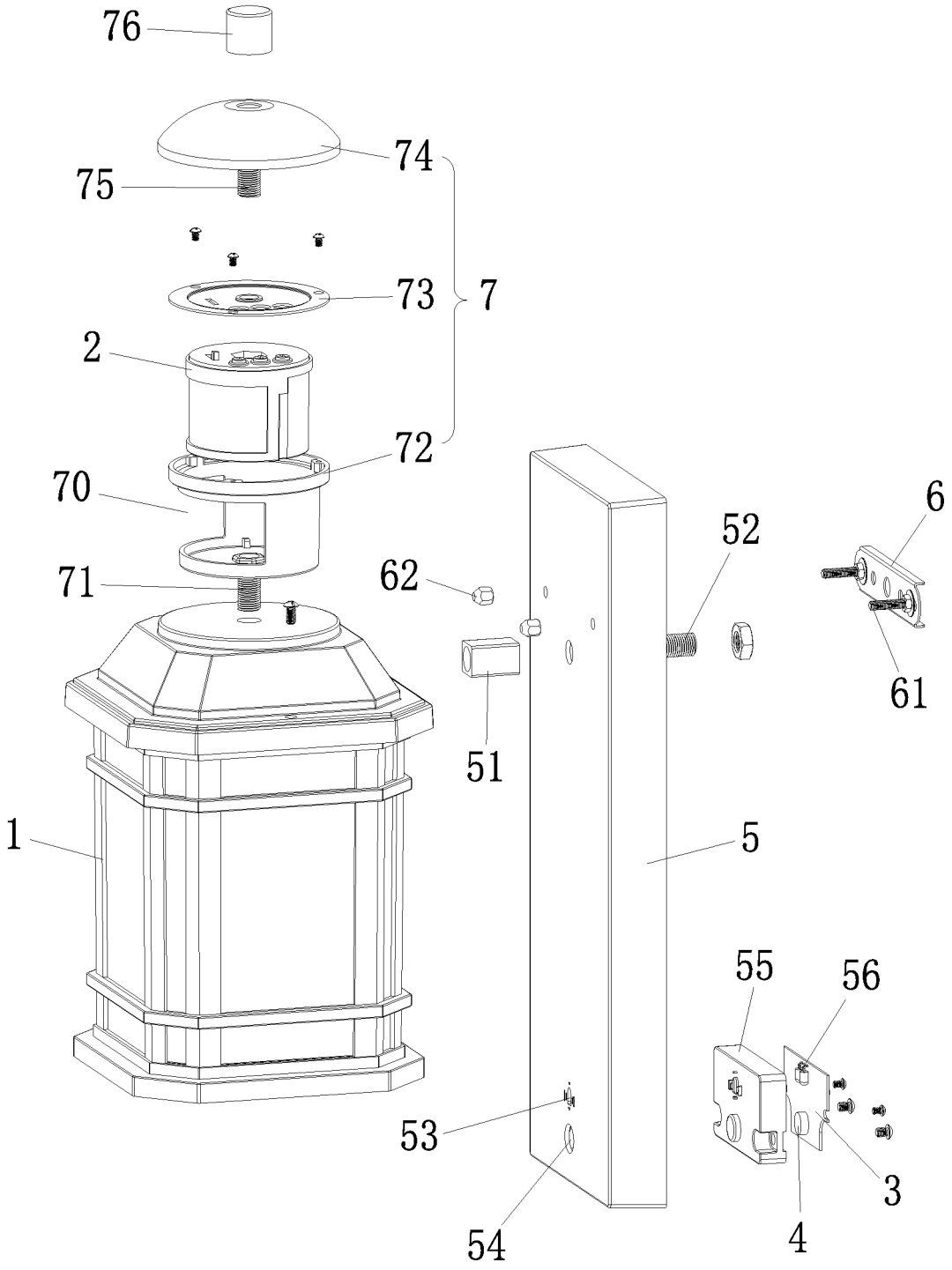
FIG. 3 is a schematic exploded view of the structure in FIG. 1.
Figure 4:
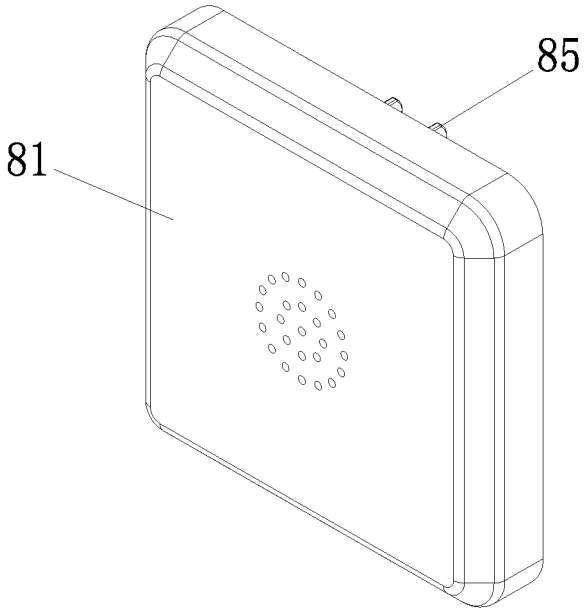
FIG. 4 is a schematic structural view of a doorbell assembly of the outdoor waterproof wall lamp system with doorbell and human body sensing functions.
Figure 5:
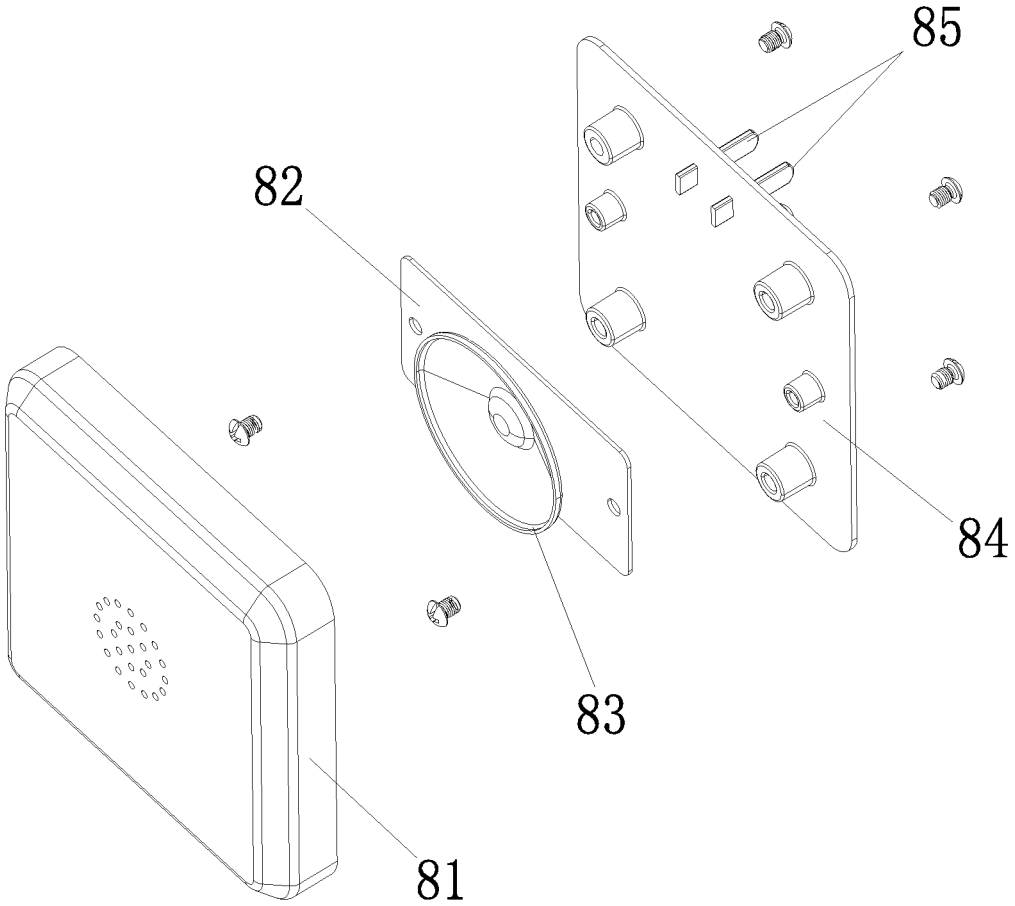
FIG. 5 is a schematic exploded view of the structure in FIG. 4.

Referring to FIG. 1 to FIG. 5, an outdoor waterproof wall lamp system with doorbell and human body sensing functions provided in the present invention comprises a lamp body assembly and a doorbell assembly.

The lamp body assembly comprises a lamp housing 1, a lamp body disposed in the lamp housing 1, a multifunctional sensor 2, a first circuit board 3, and a button switch 4. The lamp housing 1 is a waterproof lamp housing. The lamp body, the multifunctional sensor 2, and the button switch 4 are all electrically connected to the first circuit board 3. The multifunctional sensor 2 has a human body sensing module for sensing a human body to control the lamp body to be lighted. The human body sensing module is preferably a human body sensing switch. The first circuit board 3 has a control module and a transmitter.

The lamp housing 1 is provided with a mounting base 5 connected thereto on one side. Further, a column body 51 is provided between the lamp housing 1 and the mounting base 5, and a first hollow threaded tube 52 that connects the lamp housing 1 and the mounting base 5 together is provided in a through hole in the column body 51. Specifically, the left end of the first hollow threaded tube 52 extends into the lamp housing 1 and is connected with a nut, and its right end extends into the mounting base 5 and is connected with a nut; thereby connecting the lamp housing 1 and the mounting base 5. A through hole in the first hollow threaded tube 52 is used for threading.

An accommodating groove is disposed on a rear side of the mounting base 5, a light transmitting hole 53 and a mounting hole 54 are disposed in the lower end of the mounting base 5, and the mounting hole 54 is located under the light transmitting hole 53. An insulating case 55 is connected in the interior of the lower end of the mounting base 5 via a screw, and a light transmitting plate is provided at the left end of the insulating case 55. The first circuit board 3 is connected in a mounting case via a screw, the button switch 4 and the light emitting diode 56 are connected to the first circuit board 3, and the light emitting diode 56 corresponds to the light transmitting hole 53. A pressing end of the button switch 4 protrudes to the outside through a through hole in the light transmitting plate and the mounting hole 54, and the button switch 4 is a waterproof button switch. The human body sensing module may control the light emitting diode 56 to be lighted after sensing a human body.

A connecting bracket 6 is disposed on a rear side of the mounting base 5, a mounting screw 61 is connected to the connecting bracket 6, and a threaded end of the mounting screw 61 is threadedly connected with a mounting, nut 62 through a through hole in the mounting base 5.

The multifunctional sensor 2 also has a light sensing module for sensing light to control the lamp body to be lighted or extinguished, and the light sensing module is preferably a light sensing switch.

A water blocking case 7 is connected to the top of the lamp housing 1, and the multifunctional sensor 2 is mounted in the water blocking case 7. A side wall of the water blocking case 7 is provided with an escape notch 70, and sensing ends of the human body sensing module and the light sensing module correspond to the notch.

The water blocking case 7 and the lamp housing 1 are connected together by means of a second hollow threaded tube 71. Specifically, the upper end of the second hollow threaded tube 71 extends into the water blocking case 7 and is connected with a nut, and its lower end extends into the lamp housing 1 and is connected with a nut, thereby connecting the water blocking case 7 with the lamp housing 1. A through hole in the second hollow threaded tube 71 is used for threading.

The water blocking case 7 comprises, a water blocking shell 72, a cover sheet 73 connected to the top of the water blocking shell 72 via a screw, and a water blocking cover 74 disposed on the cover sheet 73. The water blocking cover 74 and the cover sheet 73 are connected together, by means of a third hollow threaded tube 75. Specifically, the upper end of the third hollow threaded tube 75 passes through a through hole in the water blocking cover 74 and is threadedly connected with a cap 76, and its lower end is threadedly connected to a threaded hole in the middle of the cover sheet 73.

An adjustment switch and a sensor mode switch is provided at the top of the multifunctional sensor 2. The adjustment and change of the function of a sensing head on the multifunctional sensor 2 can be realized by means of the adjustment switch, and the sensor mode switch.

The doorbell assembly comprises a doorbell housing 81, a second circuit board 82, and a speaker 83 that are disposed in the doorbell housing 81. The speaker 83 is connected to the second circuit board 82. The second circuit board 82 has a control module and a receiver and is communicatively connected to the first circuit board 3. Further, the second circuit board 82 is communicatively connected to the first circuit board 3 by means of the receiver and the transmitter. The speaker 83 may be controlled to sound when the button switch 4 is pressed. Specifically, when the button switch 4 is pressed, the first circuit board 3 obtains a signal and feeds information back to the second circuit board 82, and then the second circuit board 82 controls the speaker 83 to sound.

Plug sheets 85 are connected to a rear cover 84 of the doorbell housing 81, and the plug sheets 85 are electrically connected to the second circuit board 82.

In this system, corresponding control programs may be set in the control module of the first circuit board, so that following modes may be realized:

A. In a light control mode, the light sensing module controls the lamp body to be off during the daytime while always, on at night.

B. The light sensing module controls the lamp body to be off during the daytime, and to be lighted after a human body is sensed by the human body sensing module at night, and after the person leaves, the lamp body is lighted (with 100% brightness) for a preset period of time (20 to 180 seconds) and then extinguishes automatically.

C. The light sensing module controls the lamp body to be off during the daytime, and to be lighted automatically at night with a low-level brightness (LDM is set to be 0-50%) which will turn into a high-level brightness (100%) after the human body sensing module senses a human body, and after the person leaves, the high-level brightness (100%) lasts for a preset period of time (20 to 180 seconds) and then turns into the low-level brightness (LDM is set to be 0-50%).

In some embodiments, the doorbell housing is provided with a sound adjustment knob electrically connected to the second circuit board, for adjusting the volume of the speaker.

The foregoing descriptions are merely some embodiments of the present invention. For those of ordinary skills in the art, several variations and improvements can be made without departing from the inventive concepts of the present invention, and all these variations and improvements shall all fall within the protection scope of the present invention.

What is claimed is:

1. An outdoor waterproof wall lamp system with doorbell and human body sensing functions, comprising:

a lamp body assembly, comprising a lamp housing, a lamp body disposed in the lamp housing, a multifunctional sensor, a first circuit board, and a button switch, wherein the lamp body, the multifunctional sensor, and the button switch are all electrically connected to the first circuit board, and the multifunctional sensor has a human body sensing module for sensing a human body to control the lamp body to be lighted; and a doorbell assembly, comprising a doorbell housing, a second circuit board, and a speaker, wherein the second circuit board and the speaker are disposed in the doorbell housing, the speaker is connected to the second circuit board, the second circuit board is communicatively connected to the first circuit board, and the speaker may be controlled to sound when the button switch is pressed;

wherein the lamp housing is provided with a mounting base connected thereto on one side, the mounting base is provided with a light emitting diode electrically connected to the first circuit board, a light transmitting hole is provided in the mounting base corresponding to the light emitting diode, the mounting base is provided with a mounting hole through which a pressing end of the button switch protrudes from the mounting base, the mounting hole is located under the light transmitting hole, the human body sensing module may control the light emitting diode to be lighted after sensing a human body, and the multifunctional sensor also has a light sensing module for sensing light to control the lamp body to be lighted or extinguished.

2. The outdoor waterproof wall lamp system with doorbell and human body sensing functions according to claim 1, wherein a water blocking case is connected to the top of the lamp housing, the multifunctional sensor is mounted in the water blocking case, and a side wall of the water blocking case is provided with an escape notch.

3. The outdoor waterproof wall lamp system with doorbell and human body sensing functions according to claim 2, wherein the water blocking case and the lamp housing are connected together by means of a second hollow threaded tube.

4. The outdoor waterproof wall lamp system with doorbell and human body sensing functions according to claim 2, wherein the water blocking case comprises a water blocking shell, a cover sheet connected to the top of the water blocking shell, and a water blocking cover disposed on the cover sheet, and the water blocking cover and the cover sheet are connected together by means of a third hollow threaded tube.

5. The outdoor waterproof wall lamp system with doorbell and human body sensing functions according to claim 1, wherein plug sheets are connected to a rear cover of the doorbell housing, and the plug sheets are electrically connected to the second circuit board.

6. The outdoor waterproof wall lamp system with doorbell and human body sensing functions according to claim 1, wherein a column body is provided between the lamp housing and the mounting base, and a first hollow threaded tube that connects the lamp housing and the mounting base together is provided in a through hole in the column body.

7. The outdoor waterproof wall lamp system with doorbell and human body sensing functions according to claim 1, wherein a connecting bracket is disposed on a rear side of the mounting base, a mounting screw is connected to the connecting bracket, and a threaded end of the mounting screw is threadedly connected with a mounting nut through a through hole in the mounting base.

8. The outdoor waterproof wall lamp system with doorbell and human body sensing functions according to claim 1, wherein an insulating case is disposed in the mounting base, a light transmitting plate is disposed at the left end of the insulating case, the button switch and the light emitting diode are mounted on the first circuit board, the first circuit board is mounted in the insulating case, and the light transmitting plate is provided with a through hole through which the pressing end of the button switch passes.

9. The outdoor waterproof wall lamp system with doorbell and human body sensing functions according to claim 1, wherein the multifunctional sensor is provided with an adjustment switch and a sensor mode switch.

* * * * *